United States Patent [19]

Bittner

[11] 4,209,280

[45] Jun. 24, 1980

[54] LIFT TRUCK LOAD CLAMP HAVING NONRESILIENT CONTACT PAD SURFACES TEXTURED FOR DIRECTIONALLY VARIABLE RESISTANCE TO SLIPPAGE

[75] Inventor: Edward D. Bittner, Hillsboro, Oreg.

[73] Assignee: Cascade Corporation, Portland, Oreg.

[21] Appl. No.: 970,195

[22] Filed: Dec. 18, 1978

Related U.S. Application Data

[63] Continuation-in-part of Ser. No. 832,340, Sep. 12, 1977, abandoned.

[51] Int. Cl.[2] ..... B66F 9/18

[52] U.S. Cl. ..... 414/620; 294/DIG. 2; 414/621; 414/786; 414/911

[58] Field of Search ..... 414/607, 619, 620, 621, 414/642, 910, 911, 786; 294/DIG. 2

[56] References Cited

U.S. PATENT DOCUMENTS

| | | | |
|---|---|---|---|
| 2,589,101 | 3/1952 | Leguillon et al. | 414/619 |
| 2,812,089 | 11/1957 | Purpura | 414/607 |
| 2,815,878 | 12/1957 | Vance | 414/620 |
| 3,410,431 | 11/1968 | Vik | 414/607 |

FOREIGN PATENT DOCUMENTS

| | | | |
|---|---|---|---|
| 1043202 | 9/1966 | United Kingdom | 294/DIG. 2 |

*Primary Examiner*—L. J. Paperner

*Attorney, Agent, or Firm*—Chernoff & Vilhauer

[57] ABSTRACT

A load-handling clamp for lift trucks having load-engaging, nonresilient contact pad surfaces specially textured for resisting slippage of the load variably depending on direction of slip. Each load-engaging surface of the contact pads is constructed of a nonresilient material, preferably metal, in which is formed a series of spaced parallel grooves, each having beveled longitudinal edges and lands therebetween, extending generally parallel to the direction of travel of the lift truck. The provision of the grooves and their orientation with respect to the lift truck provide a load-engaging surface having minimal resistance to slippage between pad and load in the direction of travel of the lift truck during engagement of the load by the clamp, but much greater resistance to slippage perpendicular to the grooves for holding the load. In addition, the surface is exceptionally resistant to wear and to clogging with bits of paper or cardboard from the loads handled.

8 Claims, 6 Drawing Figures

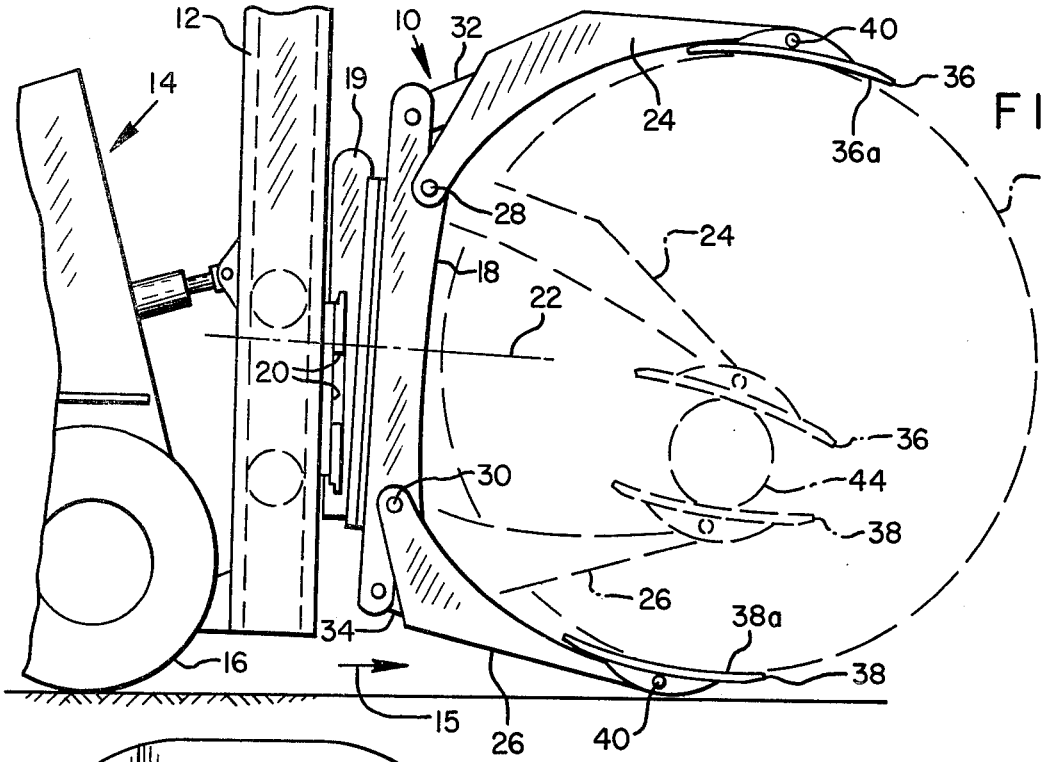
FIG. 1
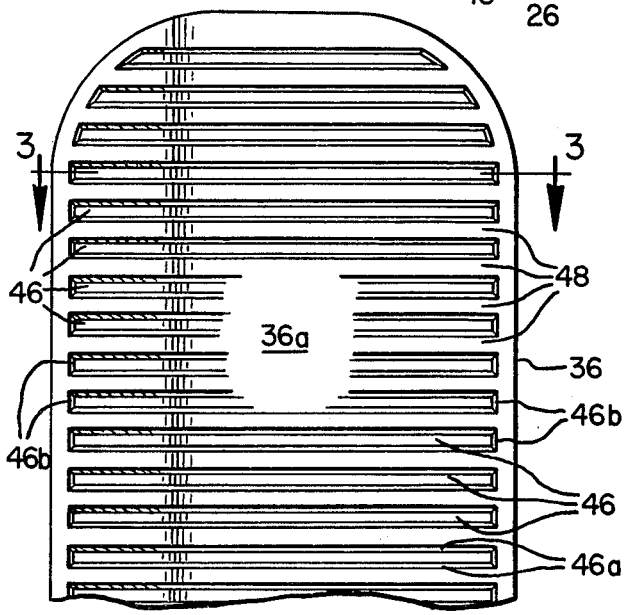
FIG. 2
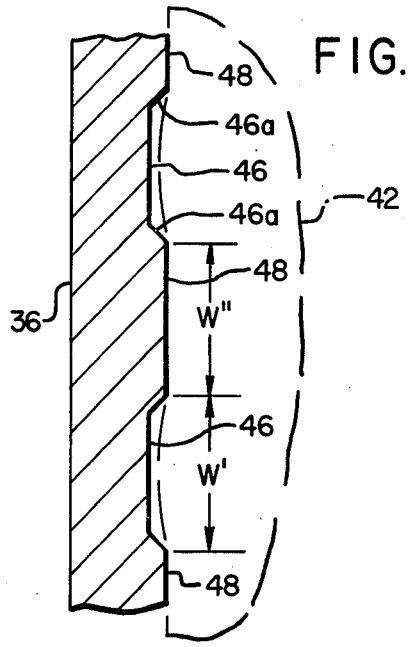
FIG. 4
FIG. 3
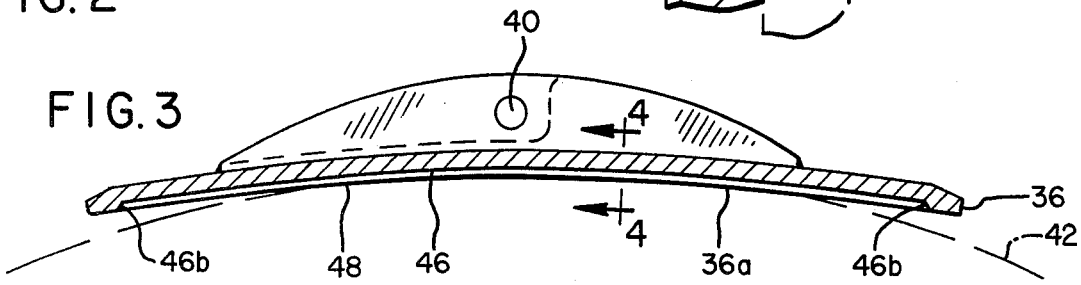

LIFT TRUCK LOAD CLAMP HAVING NONRESILIENT CONTACT PAD SURFACES TEXTURED FOR DIRECTIONALLY VARIABLE RESISTANCE TO SLIPPAGE

CROSS-REFERENCE TO OTHER APPLICATION

This application is a continuation-in-part of my copending application Ser. No. 832,340, filed Sept. 12, 1977, now abandoned.

BACKGROUND OF THE INVENTION

The present invention relates to improvements in lift truck-mounted clamping apparatus for picking up, transporting and stacking loads. More particularly the invention relates to improvements in the texturing of the load-engaging surfaces of the contact pads of a pair of openable and closeable clamp arms, such texturing being specifically designed to provide more efficient and damage-free operation in view of the manipulative procedures and fragile material characteristics peculiar to the handling of paper rolls, cardboard cartons and similar loads.

The roll engagement surfaces of lift truck paper roll clamp contact pads have conventionally comprised a roughened frictional surface of closely spaced, randomly oriented small protrusions defining irregularly shaped small depressions therebetween, formed on an elongate concave surface which curves about an axis which extends longitudinally of the surface and transversely to the lift truck so as to form a generally partial cylindrical surface. The randomly oriented, irregularly shaped fine protrusions and depressions of such conventional engagement surfaces provide frictional resistance to slippage between the contact pad and the paper roll which is equal in all directions.

With respect to lift truck carton clamps for handling loads contained in cardboard boxes and the like, the load-engaging surfaces of the contact pads have conventionally been of a flat configuration. One particularly relevant type of load-engaging surface previously utilized on this type of clamp is a resilient surface having longitudinal parallel grooves and lands formed therein as shown for example in Purpura U.S. Pat. No. 2,812,089. Inasmuch as carton clamps utilize much less clamping pressure than do paper roll clamps, the use of resilient load-engaging surfaces compensates for the relatively low clamping force by providing a high coefficient of friction to resist slippage of the loads from between the clamp arms. Purpura evidences a common belief that forming parallel grooves in the resilient load-engaging surfaces increases the resistance of the contact pads to slippage of smooth cardboard surfaces, typical of cartons and boxes, in directions of slip both parallel to and perpendicular to the grooves. While it is true that the resistance to slip of such grooved resilient contact surfaces is quite high in both directions of slip, it has been found that such resistance can be even higher if smooth resilient surfaces are utilized.

The specific procedures peculiar to lift truck paper roll and carton handling, together with the fragile nature of the rolls and cartons being handled, causes certain problems to result from the use of finely textured paper roll contact pad surfaces or resilient smooth or grooved carton clamp pad surfaces. The major problem stems from the fact that a lift truck engages a roll or stack of cartons by driving forwardly toward the roll to cause one or more of the clamp arms to "knife-in" between the side of the load and the surfaces of adjacent loads or, if a paper roll is lying horizontally rather than vertically, between the roll and the floor. In any case, the high frictional resistance to slippage provided by either finely textured conventional paper roll contact pad surfaces, or resilient carton clamp surfaces, present a disadvantage during the "knifing-in" movement because considerable frictional force between the contact surface and load can oppose such movement, causing abrasion or tearing of the relatively fragile paper or cardboard.

Moreover, both of the above-described conventional types of contact pad surfaces are highly susceptible to wear. In the case of finely textured paper roll contact pads, since the relatively fine protrusions have small bearing surfaces the depressions between them must be shallow to permit permanent indentation or cutting of the paper. Since the depth of the depressions (and accordingly the height of the protrusions) must be shallow, the texturing is highly susceptible to removal by wear from the surface, leaving a smooth metal contact pad surface having a significantly reduced capability for frictional resistance to slippage.

In the case of grooved resilient carton clamp pads, although the grooves are deeper, the resilient material is much more susceptible to wear than metal. Moreover, although wearing of a resilient grooved pad to a smooth configuration probably increases, rather than decreases, the frictional resistance of the pad to slippage, such increase in the already high frictional resistance increases the likelihood of load abrasion and damage referred to above during the "knifing-in" process.

While pads having smooth metal load-engaging surfaces have a much lower coefficient of friction than either of the above-identified types of clamp pad surfaces, and would therefore minimize the likelihood of load damage resulting from the "knifing-in" process, and are also not susceptible to any significant wear, the ability of such clamp pads to hold the weight of a load by frictional engagement thereof is also significantly reduced, with the substantial disadvantage that higher hydraulic clamping pressures would be required for handling the same loads.

SUMMARY OF THE PRESENT INVENTION

The present invention overcomes the foregoing deficiencies of conventional lift truck-mounted load clamps by providing such a clamp having a novel contact pad load-engaging surface specially adapted to the problems peculiar to the handling of loads having fragile, deformable surfaces such as paper rolls and cardboard cartons. The load-engaging surfaces of each of the two contact pads of the clamp are constructed of a nonresilient material having a relatively low coefficient of friction, preferably of metal. The pad surfaces have an array of spaced, parallel, elongate grooves formed therein, such grooves being directionally oriented to extend generally in the direction of travel of a lift truck i.e. generally longitudinally of the lift truck. Each groove has beveled longitudinal edges such that the cross section of each groove decreases in width toward the bottom of the groove. The ends of the grooves may be open or have beveled edges.

The grooves are arranged in a special parallel array forming lands between the respective grooves. The tops of the lands have considerable width, such substantial width of the lands together with the beveled longitudinal edges of the grooves enabling the grooves to have a substantially equal width to that of the lands while also having considerable depth with no resultant cutting of the fragile surfaces of the loads despite the application of clamp force necessary to manipulate the loads.

When gripping the sides of a paper roll or cardboard carton, the nonresilient lands located between the grooves press inwardly against the deformable sides of the load creating shallow, nonpermanent elongate indentations which mechanically and frictionally prevent any slipping of the load due to gravity in a direction transverse to the elongate direction of the lands and grooves. However, because of their orientation generally longitudinally of the lift truck, and because the grooved surface is substantially free of any protrusions or depressions having sides or edges extending in a direction other than the direction of the grooves and lands which would effectively resist slippage, the lands and grooves do not provide a similarly high degree of resistance to slippage between the pads and load longitudinally of the lift truck. This provides a significant advantage when the pads are required to knife-in between adjacent loads or beneath a horizontal paper roll during the engagement process, since such movement is along the direction of travel of the truck and thereby also along the longitudinal direction of the grooves and lands, permitting a sliding motion between the pads and load to which the grooved nonresilient surface offers only a minimal resistance. This resistance is much less than that offered by the aforementioned conventional finely textured paper roll pad surfaces or resilient carton clamp surfaces under the same conditions, and significantly reduces the chance of abrasion or other damage to the surface of the load during the engagement process. The reduced resistance to slip does not adversely affect the operation of the clamp in any way, so long as it is limited to a direction longitudinal of the lift truck.

Once clamping pressure is applied to the load, the shallow, nonpermanent indentations created by the nonresilient lands provide a substantial resistance to slippage in a direction transverse to the lift truck and perpendicular to the grooves and lands much greater than that which could be provided by smooth nonresilient pads, or grooved nonresilient pads resisting slippage in a direction parallel to the grooves, under the same conditions. This directional difference in resistance to slippage of grooved nonresilient pad surfaces relative to the deformable paper or cardboard surfaces increases as pad pressure increases.

This is to be contrasted with, for example, a grooved resilient contact pad which has a higher resistance to slippage of deformable paper or cardboard surfaces in all directions, and especially in a direction parallel to the grooves, than does a grooved nonresilient pad for any given pad pressure.

Also the grooved resilient pad exhibits less directional variability in resistance to slippage, apparently due to the fact that resilient lands, because of their yieldability, do not cause the same major degree of indentation in a paper or cardboard load surface as do nonresilient lands for any given pad pressure. Therefore any directional effect of grooved texturing in a resilient surface is largely outweighed by the high coefficient of friction of the resilient surface, while such texturing in a nonresilient surface has a greater directional effect on resistance to slip by causing greater indentation, and its greater directional effect cannot be outweighed by the comparatively lesser coefficient of friction of the nonresilient surface.

The foregoing differences in performance between resilient and nonresilient contact surfaces are demonstrated, for example, by the fact that a smooth rubber pad has more resistance to slip of a deformable cardboard surface than does a grooved rubber pad in a direction perpendicular to the grooves, for the same pad pressure; whereas a smooth metal pad has less resistance to such slip than does a grooved metal pad in a direction perpendicular to the grooves, for the same pad pressure.

Such differences are also demonstrated by the fact that resistance to slip of a grooved pad to a deformable cardboard surface can be reduced from a direction perpendicular to the grooves to a direction parallel to the grooves by a greater relative degree for grooved metal pads than for grooved rubber pads, with the result that metal pads have considerably less resistance to slip than rubber pads in a direction parallel to the grooves.

Thus, only with unidirectionally grooved nonresilient pad surfaces is it feasible, within the range of desirable clamping pressures, to effectively minimize resistance to slip of deformable paper or cardboard surfaces in one direction (longitudinal of the direction of travel of the truck) in order to lessen abrasion and other damage while retaining a sufficiently higher resistance to slip in another direction transverse thereto for effectively holding the weight of the load. This is because the texturing of such nonresilient pads exercises significant control over the resistance to slip and can be formed so as to have a significantly variable resistance to slip depending on direction, while the coefficient of friction of such pads, which cannot feasibly be varied directionally, is comparatively low.

The continuous elongate configuration of the nonresilient grooves also makes it extremely difficult for any bits of paper to catch in the grooves and be compacted therein so as to ultimately clog the grooves. In this regard, the sliding movement of the pads against the load longitudinally of the grooves when "knifing in" tends to dislodge any paper particles which might have previously clogged the grooves, providing a self-cleaning function.

Furthermore, the combination of the beveled longitudinal edges and substantial width of the lands permits the grooves to be of substantial width and depth without causing cutting or permanent indentation of the paper or cardboard surfaces. Such depth in turn permits the grooves and lands to remain effective to provide resistance to slippage in a direction longitudinal of the contact pads and transverse to the direction of travel of the truck even after there has been substantial wear to the pads, which in the case of metal would require much more service than is the case with previous finely textured paper roll clamp pads or resilient pads of any type.

Accordingly it is a principal objective of the present invention to provide a lift truck-mounted load clamp having nonresilient contact pad surfaces with directionally oriented texturing which provides a minimal resistance to slippage between deformable paper or cardboard load surfaces and the contact pad as the lift truck engages the load by longitudinal movement along its direction of travel, and a high resistance to slippage in a direction transverse thereto.

It is a further principal objective of the invention to provide such a clamp which is particularly resistant to clogging of the contact pads with bits of paper or cardboard from the loads handled.

It is a further significant objective of the invention to minimize wear of the nonresilient contact pad surfaces by forming them of metal.

It is a principal feature of the invention to achieve the foregoing objectives by forming an array of elongate, parallel, continuous grooves and lands in nonresilient load-engaging surfaces of contact pads oriented generally longitudinally of the lift truck along the direction of movement of the pads as they initially engage a load during forward travel of the lift truck.

It is a further feature of the invention to have no other similar protrusions or depressions in the roll-engaging surface having sides or edges oriented in any direction other than the direction of such lands and grooves which effectively resist longitudinal sliding movement of the lands and grooves with respect to a load.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a side view of an exemplary embodiment of a lift truck-mounted paper roll clamp in which the present invention is utilized.

FIG. 2 is a partial front view of the roll-engaging surface of a contact pad of the clamp, showing its texturing in accordance with the present invention.

FIG. 3 is a sectional view of the contact pad taken along line 3—3 of FIG. 2.

FIG. 4 is an enlarged partial sectional view of the contact pad taken along line 4—4 of FIG. 3, showing its clamping effect on the surface of a paper roll.

DETAILED DESCRIPTION OF THE INVENTION

Figure 5:
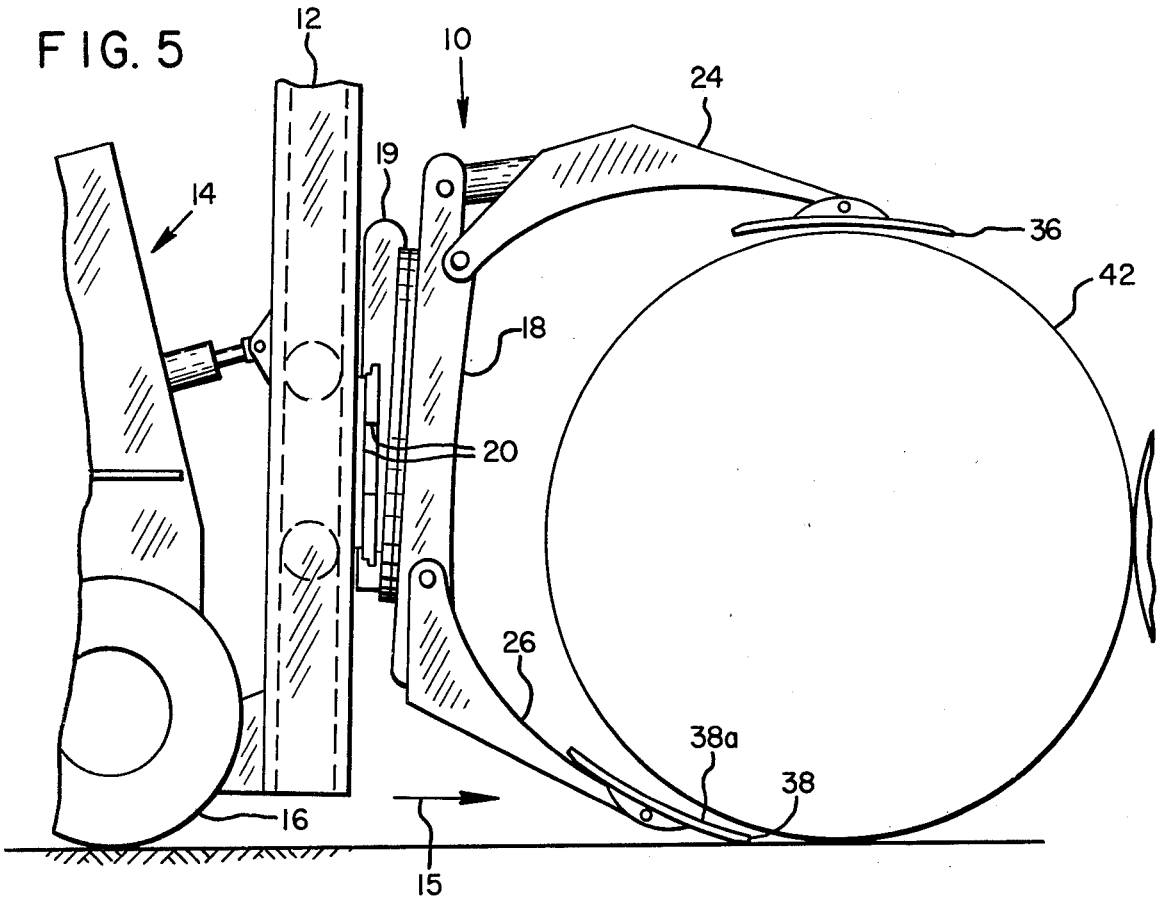
FIG. 5 is a further side view of the lift truck-mounted clamp of FIG. 1 shown in the process of initially engaging a paper roll lying horizontally on the floor.

With reference to FIG. 1, a paper roll handling clamp attachment designated generally as 10 is shown as an exemplary application of the invention. It is understood, however, that the invention is not limited to paper roll clamps but rather is also applicable to other devices such as carton clamps used for handling loads having paper or cardboard surfaces. The clamp 10 is mounted on a mast 12 at the front of a lift truck 14, such lift truck normally but not necessarily being self-propelled by an engine (not shown) which drives wheels such as 16 to move the truck selectively forward or rearward along a direction of travel 15 generally longitudinal of the truck 14. The clamp 10 has a frame 18 which is mounted, preferably but not necessarily by means of a rotator 19, upon a carriage 20 which moves vertically selectively upward or downward on the mast 12. The rotator 19 provides powered rotation of the frame 18 about an axis of rotation 22 extending longitudinally substantially in the direction of travel of the lift truck 14.

Mounted upon the frame 18 and projecting forwardly therefrom are a pair of transversely spaced, selectively openable and closeable opposing clamp arms 24 and 26 respectively. Although the clamp arms are shown in FIG. 1 as being pivotable about points 28 and 30 with respect to the frame 18 so as to open and close, they might alternatively be slidable with respect to the frame 18 toward and away from one another. Suitable power means such as double-acting hydraulic cylinders 32 and 34 control the movement and position of the respective clamp arms 24 and 26.

Connected to a forward end of each respective clamp arm 24 and 26 is a respective metal contact pad 36 and 38. The contact pads 36 and 38 have opposing paper roll-engaging metal surfaces 36*a* and 38*a* respectively each of elongate, arcuate, concave shape curving about an axis which extends longitudinally of the respective surface and transversely to the direction of travel of the lift truck, as shown in FIGS. 1, 2 and 3. Respective hinges 40 permit each contact pad to pivot with respect to its clamp arm about an axis transverse to the direction of travel of the lift truck. As can be seen from FIG. 1, the hinged movement permits the pads conformably to engage the sides of cylindrical paper rolls, such as 42 and 44 respectively, of widely varying diameters in a tangential manner both during handling and during initial engagement of the rolls.

Formed in each of the paper roll engaging surfaces 36*a* and 38*a* is an array of elongate, generally parallel, spaced, arcuate grooves 46 separated by elongate arcuate lands 48, the grooves and lands being directionally oriented so as to extend along their length in a direction transverse to the longitudinal dimension of the respective roll engaging surface and transverse to the axis of curvature thereof as seen in FIGS. 2 and 3, and generally longitudinally of the lift truck 14. Each of the grooves 46 has beveled edges 46a formed along the longitudinal sides thereof such that the cross section of each groove decreases in width toward the bottom of the groove as shown in FIG. 4. Preferably the width w′ of the grooves 46 at the top thereof (FIG. 4) is substantially the same as the width w″ of the lands 48 at the top thereof, such widths each being about one-half inch. The longitudinal ends of the respective grooves 46 may either extend completely to the edges of the contact pads, in which case the grooves are openended, or alternatively have beveled end edges 46b as shown in FIGS. 2 and 3.

As depicted in FIG. 2, the paper roll engaging surfaces containing the grooves 46 and lands 48 are substantially free of any protrusions or depressions, having sides or edges extending in a direction other than the direction of the grooves and lands, which would effectively resist longitudinal sliding movement of the grooves and lands relative to a roll of paper. The above-described directional orientation and structure of the grooves and lands on the roll engaging surfaces, and the absence of surfaces having other directional orientations within the array of grooves and lands, provides a paper roll clamp featuring a number of different operational and functional improvements which will now be described in detail.

Figure 6:
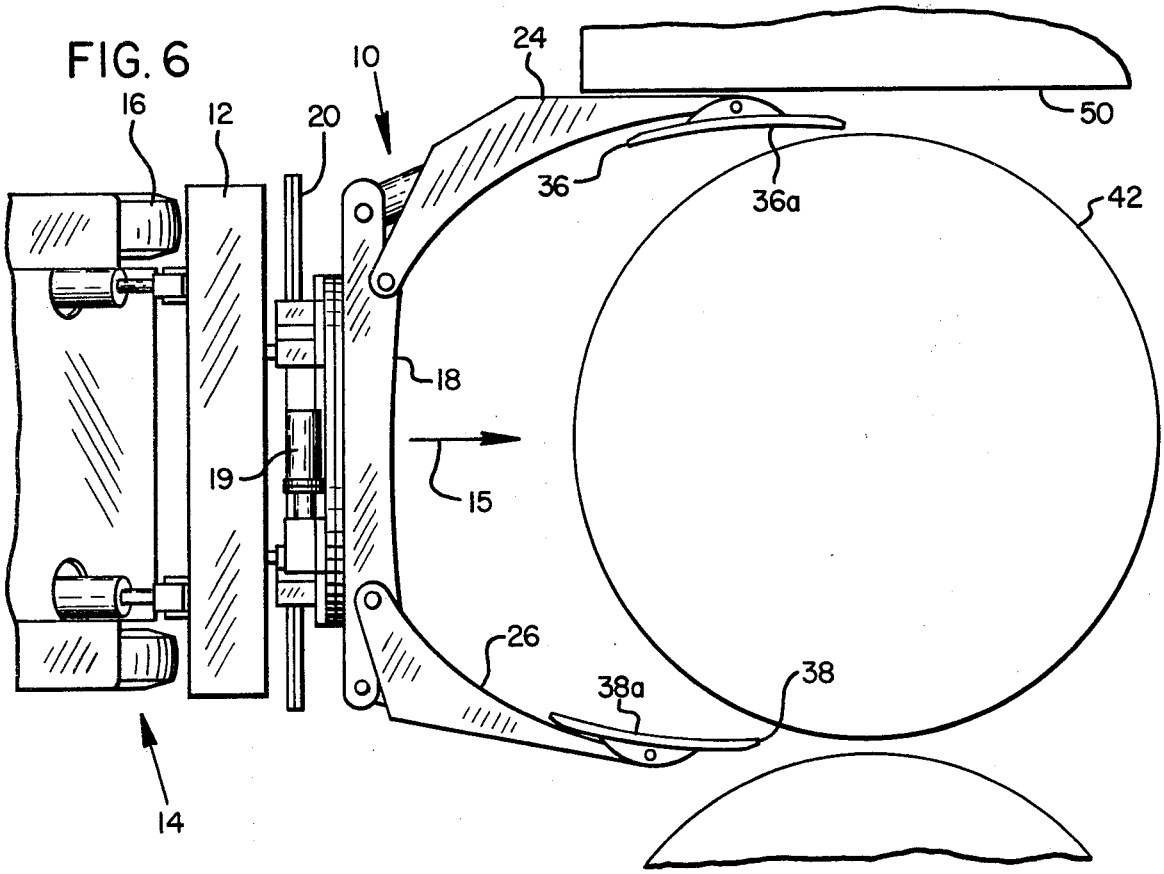
FIG. 6 is a top view of the paper roll clamp, shown in the process of initially engaging a vertically stacked paper roll.

In operation, initial engagement of a paper roll by the lift truck-mounted clamp 10 may occur under different circumstances, the two most common being illustrated in FIGS. 5 and 6 respectively. In FIG. 5, the paper roll 42 is lying in a horizontal position supported by the floor. For the clamp 10 to engage and pick up such a horizontally oriented roll, the lift truck 14 must move forwardly along its direction of travel 15 with the clamp arms 24 and 26 oriented approximately as shown in FIG. 5, sliding the lower arm 26 and its contact pad 38 as far beneath the paper roll as possible. The sliding movement of the roll-engaging surfaces 38a of the contact pad 38 is resisted frictionally by the surface of the paper roll 42, particularly with greater penetration of the contact pad beneath the roll as the forward movement produces a wedging action bringing the weight of the roll 42 to bear against the roll engaging surface 38a. If the frictional resistance to the sliding movement is sufficient, the outer layers of paper of the roll 42 in the engagement area can rather easily be torn or scuffed. Such damage, depending upon its penetration through the layers, can be substantial and costly since the ultimate user will be required to peel all layers having damaged areas off of the roll and discard such layers before the roll can be used for its intended purpose. Thus a great deal of otherwise usable paper may have to be discarded because of localized damage affecting the outer layers of various rolls.

It will be seen, however, that with the roll engaging surface of the present invention, the orientation of the elongate grooves 46 and lands 48 with respect to the direction of travel of the lift truck, i.e. extending generally longitudinally of the lift truck along its direction of travel, presents only continuous smooth surfaces in this direction throughout the roll-engaging area of the contact pad, ensuring minimal opportunity for tearing or abrasion damage to the roll as the lift truck advances forwardly during the initial engagement procedure.

Once the respective contact pads 36 and 38 have been closed to forcibly grasp the roll, as shown for example in FIG. 1, by the extension of hydraulic cylinders 32 and/or 34, the concave curvature of the roll engaging surfaces 36a and 38a of the contact pads 36 and 38 prevents slippage of the roll 42 relative to the contact pads along the longitudinal direction of the grooves 46 and lands 48. In such case the lands and grooves do not provide the primary resistance to slippage between the roll and contact pad in such longitudinal direction. Rather the partial enclosing function of the concavity relative to the convex arcuate surface of the roll provides the required mechanical hold resisting relative slippage in this direction.

In the direction transverse to the lift truck and to the longitudinal direction of the grooves and lands however, a completely different holding principle is applied. In this direction the lands and grooves provide the entire resistance to slippage primarily by forming shallow, non-permanent indentations in the paper roll surface as shown in FIG. 4 under the applied clamping force, thereby providing high resistance to slippage in this direction. This resistance is of great importance since the rotatability of the paper roll clamp 10 about the axis 22 permits the roll 42 to be rotated vertically, in which case resistance to slippage in this direction must support the entire weight of the paper roll.

FIG. 4 graphically illustrates the benefits and interrelationships of both the beveled longitudinal edges 46a of the respective grooves 46 and the relative widths w' and w'' of the tops of the grooves and lands respectively. The beveled edges serve to prevent a concentration of clamping force at the transition points between lands and grooves sufficient to cut the outer layers of the paper roll 42. In the absence of the beveled edges, the grooves 46 would have to be of a substantially narrower width w' than the width w'' of the lands 48. Such narrower grooves would not provide as great a resistance to slippage between roll and contact pad in a direction transverse to the grooves, thereby increasing the likelihood that rolls could be dropped.

Conversely, the clamping force concentrations resulting from the lack of beveled edges such as 46a could be counteracted by making the grooves 46 substantially shallower than shown in FIG. 4, without reducing their width. However this likewise would reduce their resistance to slippage of the roll, and also would defeat one of the primary objectives of the invention which is to make the grooves deep enough so that their resistance to roll slippage is not diminished even after substantial wear of the contact pad surface (preferably the depth of the grooves 46 is about one-eight inch). Accordingly it is seen that all of the competing factors are resolved by the particular beveled edge and width relationship features as illustrated in FIG. 4.

FIG. 6 illustrates the other common mode by which the paper roll clamp 10 initially engages a paper roll 42. In this mode the roll 42 is oriented vertically and the clamp 10 has been rotated 90° from the position shown in FIG. 5. In the initial engagement of the vertically oriented roll as seen in FIG. 6, the lift truck 14 moves forwardly along its direction of travel 15 with the clamp arms 24 and 26 outspread so as to knife-in between the opposite sides of the roll 42 and the sides of adjacent vertical rolls or other surfaces such as walls. Normally there is little clearance between the roll to be engaged and other surfaces because of the desire to maximize storage within a given confined space, such as a boxcar. Accordingly, as the clamp 10 in FIG. 6 is moved forwardly to engage the roll 42, the contact pad 36, for example, may have to squeeze between a side of the roll and an enclosing wall such as 50. If the clearance between roll and wall is too narrow to permit free access of the contact pad, the pad will wedge in against the side of the roll exerting pressure against the roll while slipping with respect to the roll in a manner similar to that described with respect to contact pad 38 in the discussion relating to FIG. 5. In such case the same dangers of tearing or scuffing of the outer layers of the roll exist, and the same advantages are realized by the use of the specially textured, directionally oriented contact pad engagement surface of the present invention.

Another significant objective and advantage of the invention is also accomplished by the directional orientation of the grooves and lands. If bits of paper from the surfaces of paper rolls should temporarily cling to the roll-engaging surface of a contact pad, the sliding motion of the pad during the initial engagement of paper rolls will subsequently tend to remove the paper with a wiping motion unimpeded by any contact pad surfaces or edges extending transversely to the wiping motion. This provides the roll engaging surface with an important self-cleaning capability as a by-product of the directionally variable slip-resistance of the surface. It has been determined that beveled ends such as 46b (FIG. 3) of the grooves 46 do not detract from this self-cleaning feature.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a lift truck adapted to move longitudinally in a direction of travel having a lifting apparatus at its forward end for raising and lowering a load vertically, a load-handling attachment mounted on said lifting apparatus comprising:

(a) a frame mounted on a portion of said lifting apparatus so as to be selectively raised and lowered vertically by said lifting apparatus;

(b) a pair of forwardly-projecting, selectively openable and closeable opposing clamp arms mounted upon said frame;

(c) power means mounted upon said frame for selectively opening and closing said clamp arms;

(d) a pair of contact pads, each connected to a forward end of a respective one of said pair of clamp arms, said contact pads having opposing load-engaging nonresilient surfaces;

(e) means defining an array of elongate, generally parallel, spaced grooves formed in each of said load-engaging nonresilient surfaces separated by elongate nonresilient lands between said grooves, said grooves and lands being directionally oriented so as to extend along their lengths in a direction generally longitudinal of said lift truck in the direction of travel thereof for sliding longitudinally with respect to a load as said lift truck moves forwardly along said direction of travel to engage said load.

2. The apparatus of claim 1 wherein said load-engaging nonresilient surfaces and nonresilient lands are metal.

3. The apparatus of claim 1 wherein each of said grooves has beveled edges formed along the longitudinal sides thereof such that the cross section of each groove decreases in width toward the bottom of said groove.

4. The apparatus of claim 3 wherein the width of said grooves at the top thereof is substantially the same as the width of said lands at the top thereof.

5. The apparatus of claim 1 wherein said load-engaging surfaces are substantially free of any other grooves or lands, having sides extending in a direction other than the direction of said grooves and lands, which effectively resist said longitudinal sliding movement of said grooves and lands with respect to a load.

6. In a lift truck adapted to move longitudinally in a direction of travel having a lifting apparatus at its forward end, a load-handling attachment mounted on said lifting apparatus for handling a load having a deformable surface of paper or the like, said attachment comprising:

(a) a frame mounted on a portion of said lifting apparatus so as to be selectively raised and lowered vertically by said lifting apparatus;

(b) a pair of forwardly-projecting, selectively openable and closeable opposing clamp arms mounted upon said frame;

(c) power means mounted upon said frame for selectively opening and closing said clamp arms;

(d) a pair of contact pads, each connected to a forward end of a respective one of said pair of clamp arms, said contact pads having opposing nonresilient load-engaging surfaces; and (e) directionally-oriented texturing means formed in each of said nonresilient load-engaging surfaces for providing resistance to sliding movement, between said deformable surface of said load and the respective load-engaging surface, which is less in a direction generally longitudinal of said lift truck than in a direction transverse thereto.

7. The apparatus of claim 6 wherein said nonresilient load-engaging surfaces are metal.

8. A method of handling a load, having a deformable surface of paper or the like, by means of a load-handling clamp having a pair of forwardly-projecting, selectively openable and closeable opposing clamp arms mounted upon a lift truck adapted to move forwardly in a direction of travel, said method comprising:

(a) supporting upon said pair of clamp arms a pair of contact pads having opposing nonresilient load-engaging surfaces with an array of elongate, generally parallel, spaced grooves formed in each of said nonresilient surfaces separated by elongate nonresilient lands between said grooves;

(b) orienting said elongate grooves and lands to extend generally longitudinally along the direction of travel of said lift truck;

(c) engaging said load by advancing said lift truck forwardly toward said load along said direction of travel and longitudinally of said grooves and lands until said contact pads are on opposite sides of said load;

(d) grasping said load by closing said clamp arms and thereby pressing said nonresilient lands of said contact pads against said deformable surface of said load forming elongate indentations in said deformable surface which extend generally along the direction of travel of said lift truck; and (e) lifting said load by means of said clamp arms in a direction transverse to the direction of travel of said lift truck.

* * * * *

UNITED STATES PATENT AND TRADEMARK OFFICE

CERTIFICATE OF CORRECTION

PATENT NO. : 4,209,280

DATED : June 24, 1980

INVENTOR(S) : Edward D. Bittner

It is certified that error appears in the above-identified patent and that said Letters Patent are hereby corrected as shown below:

Col. 2, line 65 Change "special" to --spaced--.

Col. 7, line 2 Change "surfaces" to --surface--.

Signed and Sealed this

Second Day of September 1980

[SEAL]

*Attest:*

SIDNEY A. DIAMOND

*Attesting Officer*

*Commissioner of Patents and Trademarks*

REEXAMINATION CERTIFICATE (25th)

United States Patent [19]

Bittner

[11] B1 4,209,280

[45] Certificate Issued Oct. 19, 1982

[54] LIFT TRUCK LOAD CLAMP HAVING NONRESILIENT CONTACT PAD SURFACES TEXTURED FOR DIRECTIONALLY VARIABLE RESISTANCE TO SLIPPAGE

[75] Inventor: Edward D. Bittner, Hillsboro, Oreg.

[73] Assignee: Cascade Corporation, Portland, Oreg.

Reexamination Request

No. 90/000,084, Oct. 13, 1981

Reexamination Certificate for:

| | |
|---|---|
| Patent No.: | **4,209,280** |
| Issued: | **Jun. 24, 1980** |
| Appl. No.: | **970,195** |
| Filed: | **Dec. 18, 1978** |

Certificate of Correction issued Sep. 2, 1980.

Related U.S. Application Data

[63] Continuation-in-part of Ser. No. 832,340, Sep. 12, 1977, abandoned.

[51] Int. Cl.[3] ..... B66F 9/18

[52] U.S. Cl. ..... 414/620; 294/DIG. 2, 414/621; 414/786; 414/911

[58] Field of Search.....414/620, 621, 911; 294/DIG. 2

[56] References Cited

U.S. PATENT DOCUMENTS

| | | | |
|---|---|---|---|
| Re 28,309 | 1/1975 | Farmer | 414/621X |
| 2,812,089 | 11/1957 | Purpura | 414/607 |

FOREIGN PATENT DOCUMENTS 238903 1/1961 Australia.

OTHER PUBLICATIONS

Sales Brochure, Long Reach Manufacturing Division of Anderson, Clayton & Co., Houston, Tex., "weld on box handling arms" undated but at least 1971. Pages 1, 18, 24 from price list of Long Reach Manufacturing Division "Pulp Bale Clamps" & "Box handling Arms".

Manufacturing Drawing Nos. 6701–D & 6701–B; Long Reach Manufacturing Division; Dec. 13, 1967.

Manufacturing Drawing No. 6759, "WC–2740 Box Handling Arm" Long Reach Manufacturing Division; March 31, 1966.

Manufacturing Drawing No. 12834–L, "27X24 High Arm Assembly", Long Reach Manufacturing Division; February 20, 1976.

Manufacturing Drawing No. 6156–L, "Pulp Bale Handling Arm", Long Reach Manufacturing Division; September 5, 1966.

*Primary Examiner*—L. J. Paperner

[57] ABSTRACT

A load-handling clamp for lift trucks having load-engaging, nonresilient contact pad surfaces specially textured for resisting slippage of the load variably depending on direction of slip. Each load-engaging surface of the contact pads is constructed of a nonresilient material, preferably metal, in which is formed a series of spaced parallel grooves, each having beveled longitudinal edges and lands therebetween, extending generally parallel to the direction of travel of the lift truck. The provision of the grooves and their orientation with respect to the lift truck provide a load-engaging surface having minimal resistance to slippage between pad and load in the direction of travel of the lift truck during engagement of the load by the clamp, but much greater resistance to slippage perpendicular to the grooves for holding the load. In addition, the surface is exceptionally resistant to wear and to clogging with bits of paper or cardboard from the loads handled.

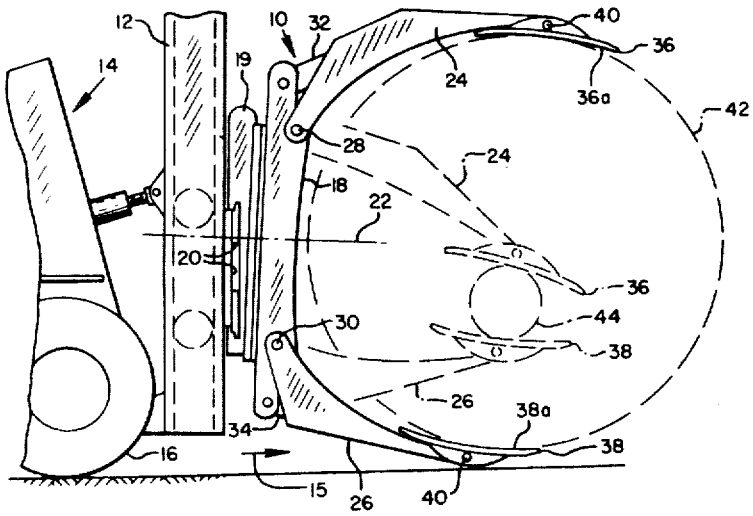

REEXAMINATION CERTIFICATE ISSUED UNDER 35 U.S.C. 307.

THE PATENT IS HEREBY AMENDED AS INDICATED BELOW.

Matter enclosed in heavy brackets appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 4, 6 and 8 are determined to be patentable as amended.

Claims 2, 3, 5 and 7, dependent on amended claims, are determiend to be patentable.

1. In a lift truck adapted to move longitudinally in a direction of travel having a lifting apparatus at its forward end for raising and lowering a load vertically, a load-handling attachment mounted on said lifting apparatus *for handling a load having a deformable surface of paper or the like, said attachment* comprising:

(a) a frame mounted on a portion of said lifting apparatus so as to be selectively raised and lowered vertically by said lifting apparatus;

(b) a pair of forwardly-projecting selectively openable and closeable opposing clamp arms mounted upon said frame;

(c) power means mounted upon said frame for selectively opening and closing said clamp arms;

(d) a pair of contact pads, each connected to a forward end of a respective one of said pair of clamp arms, said contact pads having opposing load-engaging nonresilient surfaces;

(e) means defining an array of elongate, generally parallel, spaced groves formed in each of said load-engaging nonresilient surfaces separated by elongate nonresilient lands between said grooves *having nonresilient land surfaces at the tops thereof for engaging said deformable surface of said load,* said grooves and lands being directionally oriented so as to extend along their lengths in a direction generally longitudinal of said lift truck in the direction of travel thereof for sliding longitudinally with respect to [a] *said* load as said lift truck moves forwardly along said direction of travel to engage said load, *said load-engaging nonresilient surfaces being free of any protrusions or depressions, having sides or edges extending in a direction along said surfaces other than the longitudinal direction of said grooves and lands, which effectively resist said longitudinal sliding of said grooves and lands with respect to said deformable surface while in contact therewith, said land surfaces having sufficient width, relative to the width of said grooves, to form nonpermanent indentations in said deformable surface while avoiding any cutting or permanent indentation thereof when engaging said deformable surface with sufficient force to enable said clamp arms to lift said load vertically.*

4. The apparatus of claim [3] *1* wherein the width of said grooves at the top thereof is substantially the same as the width of said lands at the top thereof.

6. In a lift truck adapted to move longitudinally in a direction of travel having a lifting apparatus at its forward end, a load-handling attachment mounted on said lifting apparatus for handling a load having a deformable surface of paper or the like, said attachment comprising:

(a) a frame mounted on a portion of said lifting apparatus so as to be selectively raised and lowered vertically by said lifting apparatus;

(b) a pair of forwardly-projecting, selectively openable and closeable opposing clamp arms mounted upon said frame;

(c) power means mounted upon said frame for selectively opening and closing said clamp arms;

(d) a pair of contact pads, each connected to a forward end of a respective one of said pair of clamp arms, said contact pads having opposing nonresilient load-engaging surfaces; and (e) directionally-oriented texturing means formed in each of said nonresilient load-engaging surfaces for providing resistance to sliding movement, between said deformable surface of said load and the respective load-engaging surface, which is less in a direction generally longitudinal of said lift truck than in a direction transverse thereto, *said nonresilient load-engaging surfaces being free of any protrusions or depressions which effectively resist sliding of said nonresilient load-engaging surfaces in said direction generally longitudinal of said lift truck with respect to said deformable surface while in contact therewith, said directionally-oriented texturing means including means for forming nonpermanent indentations in said deformable surface while avoiding any cutting or permanent indentation thereof when engaging said deformable surface with sufficient force to enable said clamp arms to lift said load vertically.*

8. A method of handling a load, having a deformable surface of paper or the like, by means of a load-handling clamp having a pair of forwardly-projecting, selectively openable and closeable opposing clamp arms mounted upon a lift truck adapted to move forwardly in a direction of travel, said method comprising:

(a) supporting upon said pair of clamp arms a pair of contact pads having opposing nonresilient load-engaging surfaces with an array of elongate, generally parallel, spaced grooves formed in each of said nonresilient surfaces separated by elongate nonresilient lands between said grooves, *said nonresilient load-engaging surfaces being free of any protrusions or depressions, having sides or edges extending in a direction along said surfaces other than the longitudinal direction of said grooves and lands, which effectively resist sliding of said grooves and lands along said deformable surface of said load while in contact therewith;*

(b) orienting said elongate grooves and lands to extend generally longitudinally along the direction of travel of said lift truck;

(c) engaging said load by advancing said lift truck forwardly toward said load along said direction of travel and longitudinally of said grooves and lands until said contact pads are on opposite sides of said load *by sliding said grooves and lands longitudinally along said deformable surface of said load while in contact therewith;*

(d) grasping said load by closing said clamp arms and [thereby] pressing said nonresilient lands of said contact pads against said deformable surface of said load *with sufficient force to enable said clamp arms to lift said load vertically, thereby* forming elongate *nonpermanent* indentations in said deformable surface which extend generally along the direction of travel of said lift truck

*while avoiding any cutting or permanent indentation of said deformable surface,* and (e) lifting said load by means of said clamp arms in a direction transverse to the direction of travel of said lift truck.

* * * * *